US005450276A

United States Patent [19]

Olifant et al.

[11] Patent Number: 5,450,276

[45] Date of Patent: Sep. 12, 1995

[54] ELECTROMAGNETIC SWITCH DEVICE

[75] Inventors: Jacques Olifant, Nanterre; Bruno Palacio, Meudon, both of France

[73] Assignee: Telemecanique, Rueil Malmaison, France

[21] Appl. No.: 212,820

[22] Filed: Mar. 15, 1994

[30] Foreign Application Priority Data

Mar. 17, 1993 [FR] France ..... 93 03172

[51] Int. Cl.[6] ..... H01H 47/00

[52] U.S. Cl. ..... 361/152; 361/187

[58] Field of Search ..... 361/139, 152, 154, 160, 361/170, 179, 180, 181, 187, 159

[56] References Cited

U.S. PATENT DOCUMENTS

| | | | |
|---|---|---|---|
| 3,059,176 | 10/1962 | Richter et al. | 324/423 |
| 3,568,008 | 3/1971 | Tanimura | 361/210 |
| 3,870,931 | 3/1975 | Myers | 361/194 |
| 4,608,620 | 8/1986 | Hines | 361/154 |
| 5,161,083 | 11/1992 | Mohler et al. | 361/143 |
| 5,172,298 | 12/1992 | Shimizu et al. | 361/152 |
| 5,241,218 | 8/1993 | Page | 361/154 |

FOREIGN PATENT DOCUMENTS

| | | |
|---|---|---|
| 1921232 | 11/1969 | Germany . |
| 3506053 | 8/1986 | Germany . |

OTHER PUBLICATIONS

Patent Abstract of JP-A-58-161,305, Sep. 24, 1983, Tomohide Matsumoto, "Electromagnetic Driving Apparatus".

*Primary Examiner*—Jeffrey A. Gaffin

*Attorney, Agent, or Firm*—Oblon, Spivak, McClelland, Maier & Neustadt

[57] ABSTRACT

An electromagnetic switch device which features a mobile assembly having contacts cooperating with fixed contacts and displaced by a solenoid. The switch also features an analog sensor for measuring the position of the mobile assembly and electronics for processing the output signal of the position sensor to control the coil current.

14 Claims, 2 Drawing Sheets

ELECTROMAGNETIC SWITCH DEVICE

BACKGROUND OF THE INVENTION

1. Field of the Invention

The present invention concerns a switch device including a mobile assembly provided with contacts cooperating with fixed contacts and moved by a solenoid, the position of the mobile assembly being sensed by a sensor in order to control the coil current.

2. Description of the Prior Art

Document U.S. Pat. No. 3,568,008 describes the provision of a switch device with a sensor for sensing the position of the mobile assembly in order to control the coil current.

SUMMARY OF THE INVENTION

An object of the present invention is to control the coil current over all of the travel of the mobile assembly. It improves the closing power and the electrical and mechanical durability of the device. The speed at which the poles of the device close is controlled or adjusted and contact bounce is reduced. The invention enables the electromechanical parameters of the contactor to be adjusted independently of exterior conditions, in particular supply voltage fluctuations.

The switch according to the invention comprises an analog type sensor for measuring the position of the mobile assembly and electronic means for processing the output signal of the position sensor to control the coil current.

According to one feature of the invention the sensor is a potentiometer sensor comprising a linear sensitive member and a mobile cursor resting on the member.

According to one feature of the invention the linear sensitive member is a straight conductive strip forming a membrane separated, when inactive, from a resistive track.

According to one feature of the invention the electronic means comprise an inrush current static contact which controls the supply of power to the coil and is itself controlled by a control circuit receiving the output signals of the analog position sensor.

According to one feature of the invention the control circuit comprises a voltage detector which controls a pulse width modulator circuit periodically activating the coil supply control static contact, the modulator circuit receiving the output signal of a current sensor in series with the coil and a set point value at the output of a generator associated with the position sensor.

BRIEF DESCRIPTION OF THE DRAWING

The invention is described in more detail and by way of example with reference to embodiments of the invention shown in the appended drawings.

DETAILED DESCRIPTION OF THE PREFERRED EMBODIMENT

Figure 1:
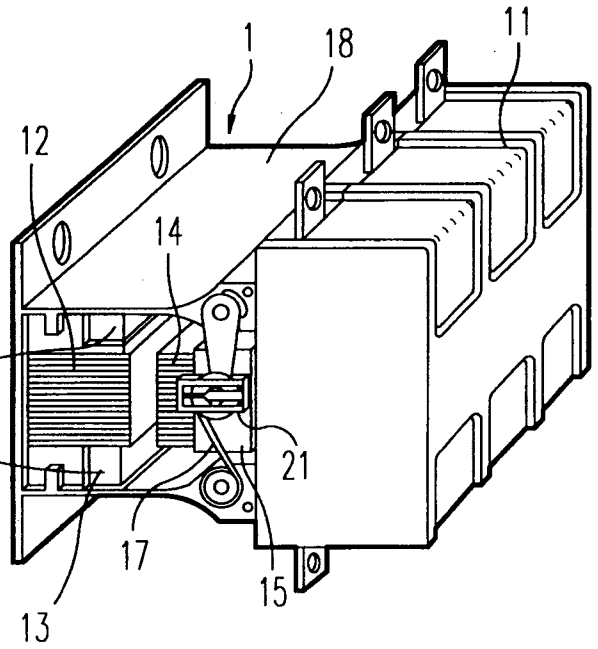
FIG. 1 is a diagram showing the device of the invention with the casing open.

The contactor device shown in FIG. 1 comprises a plastics material casing 11 housing a set of power switches controlled by electromagnetic means. This system includes a mobile assembly constituting the contact-holder 15 carrying power switch moving contacts.

The electromagnetic means for operating the mobile assembly are housed in a casing 18 fixed to the casing 11. They comprise a solenoid with a fixed yoke 12, an excitation coil 13 and a moving armature 14 coupled to the contact-holder 15. The armature 14 is moved away from the yoke when the solenoid is not operated by a return spring 17.

The position of the mobile assembly 15 is registered by an analog position sensor 2.

Figure 2:
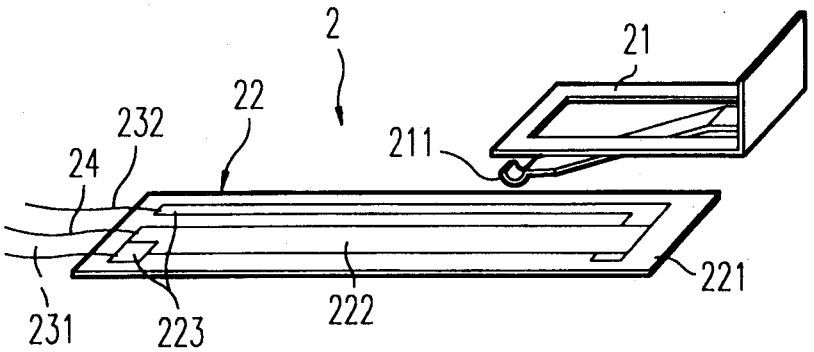
FIG. 2 shows one embodiment of the analog position sensor fitted to the device from FIG. 1.
Figure 3:
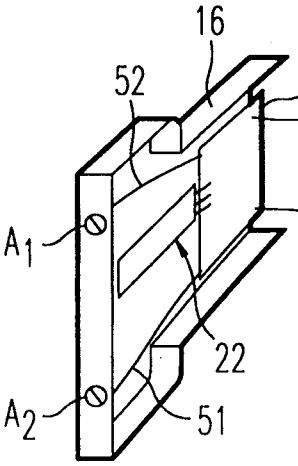
FIG. 3 shows the sensor from FIG. 2 in cross-section.

In the embodiment of FIGS. 2 and 3 the sensor 2 is a membrane linear potentiometer type sensor. It has the advantage of being sealed and of having a long service life. It has two separate parts: a linear sensitive member 22 and a cursor 21. The cursor 21 is mechanically fixed to one side of the contact-holder 15. The sensitive member 22 is fixed to the inside of the casing 11, specifically to the inside of a side cover 16 which is fixed to the remainder of the casing.

The sensitive member 22 comprises a strip of plastics material 221 carrying a resistive track 223 associated with a flexible conductive strip 222. The resistive track 223 and the conductive strip 222 are rectilinear. The conductive strip 222 forms a membrane and faces the resistive track 223 at a distance therefrom so that it is separated from it when it is not operated. Because of its elasticity in the transverse direction, the conductive strip 222 can be pressed against the resistive track 223 by a locally applied force. It then serves as an electrical collector. The component parts of the member 22 are isolated from the outside environment by insulative films. The ends of the resistive track 223 are connected by conductors 231, 232, the conductive strip 222 being connected to a conductor 24.

The cursor 21 includes a leaf spring 211, the end of which presses against the conductive strip 222. When the leaf spring 211 applies a force to the conductive strip 222 the latter is locally connected electrically to the resistive track 25.

Figure 5:
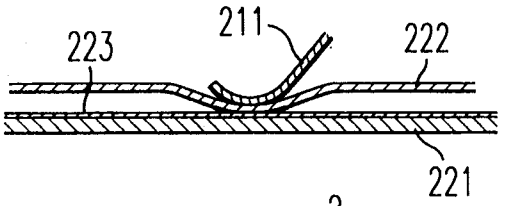
FIG. 5 shows a different embodiment of the position sensor of the device according to the invention.
Figure 5:
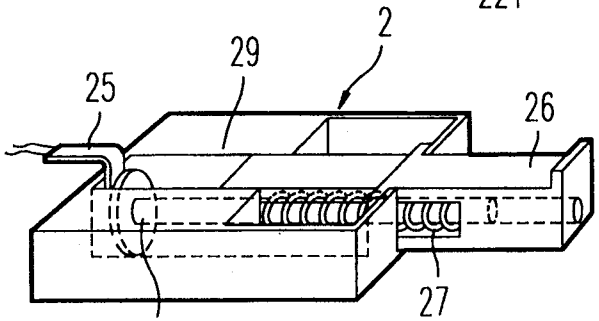
Figure 6:
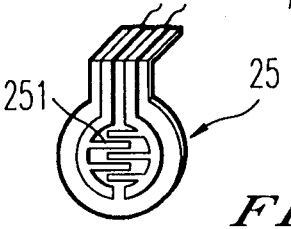
FIG. 6 shows part of FIG. 5 in more detail.

FIGS. 5 and 6 show a different embodiment of the sensor 2. This sensor 2 is constructed in a similar way to an additional block of contacts of the contactor. It includes a pressure-sensitive member 25 on which act force application means displaced by the mobile assembly 15. Force is applied to the sensitive member 25 through a piston 28 which is spring-loaded by a spring 27. The compression of this spring is related to the position of a plunger 26 mechanically connected to the mobile assembly 15.

The sensitive member 25 comprises two face-to-face insulative films. One side of one film carries an array of interleaved conductive strips 251. One side of the other film carries a semiconductor polymer. If the two sides are pressed together, the conductor array is shunted by the polymer. The resistance of the sensitive member is inversely proportional to the force applied in the direction normal to the surface of the member.

The magnitude of the force is therefore dependent on the value of the initial compression of the spring 27 and on its stiffness. The increase in force proportional to the displacement of the mobile assembly is converted to a variation in resistance by the sensitive member 25.

The position sensor 2 produces a signal representative of the position of the mobile assembly 15. This signal is processed by an electronic circuit 3 implemented on a printed circuit board. The electronic circuit 3 is preferably housed in the casing of the device. The control terminals $A_1$ and $A_2$ of the coil are connected by conductors 51 and 52 to the electronic circuit 3.

Figure 4:
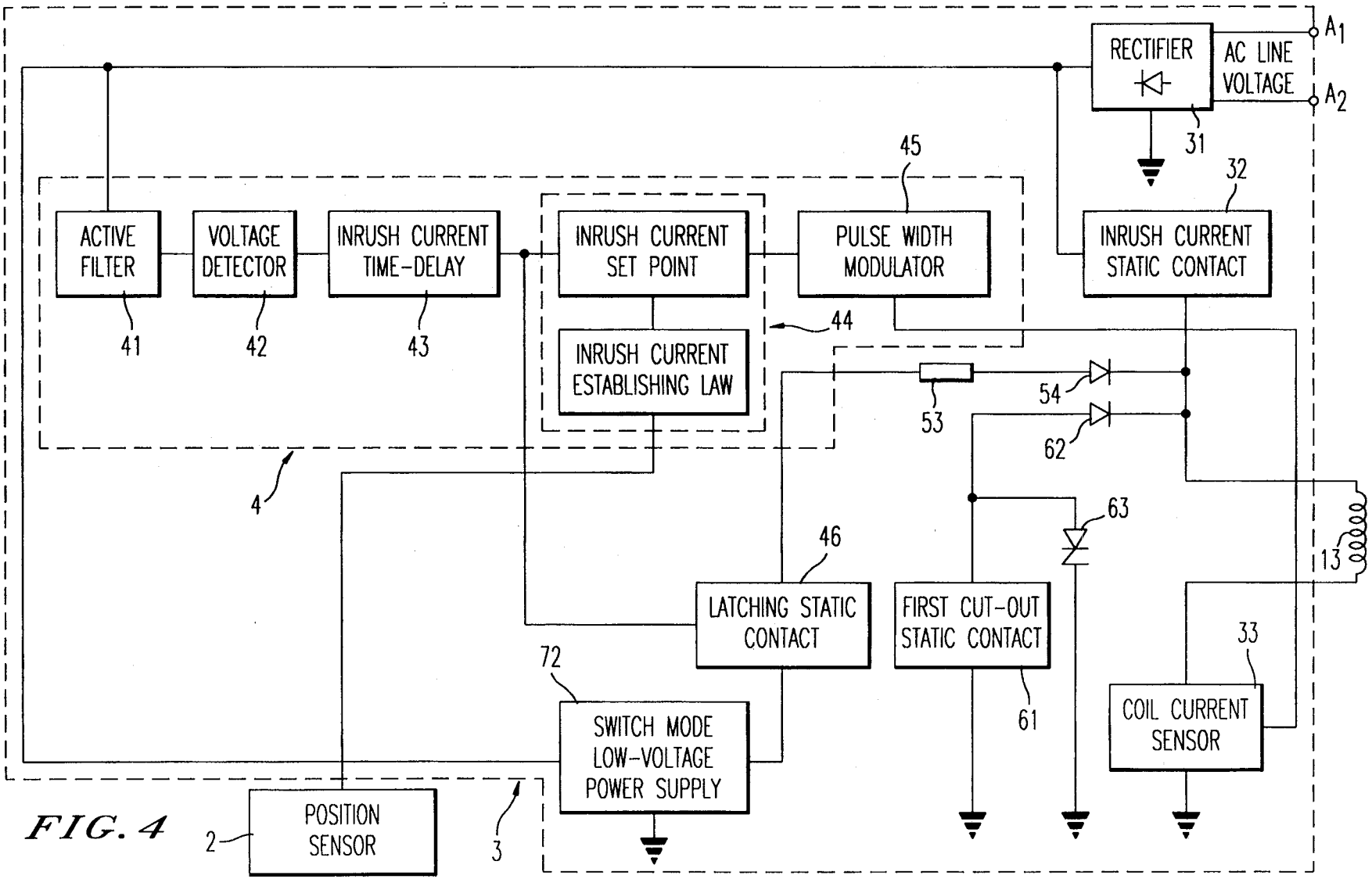
FIG. 4 is a block diagram of the electronic circuit of the device.

The control terminals $A_1$ and $A_2$ are connected to a rectifier circuit 31, see FIG. 4. The coil 13 is connected to the outputs of the rectifier circuit 31 and the coil current is controlled by an inrush current static contact 32 controlled by a control circuit 4 receiving the output signals of the analog position sensor 2, the control circuit 4 forming part of electronic circuit 3, as shown in FIG. 4.

The control circuit 4 comprises a voltage detector 42 connected via an active filter 41 to the outputs of the rectifier circuit 31. The voltage detector 42 triggers a time-delay circuit 43 which excites a pulse width modulator circuit 45 which periodically activates the inrush current static contact 32. The modulator circuit 45 receives the output signal of a current sensor 33 in series with the coil 13 and a set point value present at the output of a generator 44 defining the inrush current establishment law. The generator is itself dependent on the position sensor 2.

The coil 13 can be supplied with power from a low-voltage power supply 72 through a latching static contact 46 resistor 53 and a diode 54.

A "first cut-out" static contact 61 is connected in series with a freewheel diode 62 across the coil 13. A Zener diode 63 is connected in parallel with the static contact 61.

The device operates as follows:

When the device is switched on, the voltage detector 42 enables operation for a threshold equal to a fraction of the control voltage Vc. This value can be in the order of 0.75 Uc, for example. The change of state of the detector 42 triggers the time-delay circuit 43 which excites the pulse width modulator circuit 45 periodically activating the inrush static contact 32. The current in the coil 13 then takes a mean value dependent on the pulse width modulation level resulting from comparing the output signal from the current sensor 33 and the set point value present at the output of the generator 44.

At the end of the time-delay the inrush static contact 32 is off (open) and the latching static contact 46 closes. The current required to close the solenoid is then supplied to the coil 13 by the low-voltage power supply 72.

If the control voltage Vc decreases progressively the voltage detector 42 causes the solenoid to drop out by opening the static contact 32 at a second threshold whose value is in the order of 0.50 Vc, for example.

The first cut-out static contact 61 compensates for the time-delay effect of the freewheel diode 62 when the supply voltage is removed. The value of the Zener diode 63 sets the rate at which the current decreases in the coil 13.

It is obvious that without departing from the scope of the invention variants, detailed improvements and substitution of equivalent means are feasible. From the analog instantaneous position indication supplied by the sensor the crushing travel of the main contacts could be evaluated by comparing this information with a signal generated by the start of flow of current in the these contacts.

There is claimed:

1. A contractor comprising in a casing:

a mobile assembly;

a solenoid for displacing the mobile assembly, the solenoid including an excitation coil through which a coil current flows;

a position analogical sensor for measuring a position of the mobile assembly;

electronics means for processing an output signal of said position sensor to control the coil current;

and wherein said position analogical sensor is a potentiometer sensor comprising a linear sensitive member fixed to an inside of said casing and a mobile cursor mechanically fixed to said mobile assembly and resting on said linear sensitive member.

2. The contractor according to claim 1, wherein said linear sensitive member is a straight conductive strip forming a membrane separated, when inactive, from a resistive track.

3. The contractor according to claim 1, wherein said electronic means comprises an inrush current static contact which controls the supply of power to said coil and is itself controlled by a control circuit receiving the output signals of said analog position sensor.

4. The contractor according to claim 3, wherein said control circuit comprises a voltage detector which controls a pulse width modulator circuit periodically activating a coil supply control static contact, said modulator circuit receiving the output signal of a current sensor in series which said coil and a set point value at the output of a generator associated with said position sensor.

5. The contractor according to claim 1, wherein said excitation coil can be supplied with power when latched on by a latching power supply controlled by a latching static contact controlled by a time-delay circuit.

6. The contractor according to claim 5, wherein said excitation latching power supply is of a switching mode type.

7. The contractor according to claim 1, wherein said excitation coil has a fast cut-out circuit provided by a static contact.

8. An electromagnetic switch device comprising:

a mobile assembly;

a solenoid for displacing the mobile assembly, the solenoid including an excitation coil through which a coil current flows;

an analog sensor for measuring a position of the mobile assembly;

a latching static contact for supplying power to the excitation coil when latched; and a time-delay circuit for controlling the latching static contact.

9. The electromagnetic switch device according to claim 5, further comprising:

a coil current sensor in series with the excitation coil;

a pulse width modulator for receiving an output of the analog sensor and the coil current sensor;

an inrush coil supply control static contact for receiving an output of the pulse width modulator and for controlling the coil current flowing through the excitation coil.

10. The electromagnetic switch device according to claim 8, wherein said analog sensor is a potentiometer sensor comprising a linear sensitive member and a mobile cursor resting on said linear sensitive member.

11. The electromagnetic switch device according to claim 10, wherein said linear sensitive member is a straight conductive strip forming a membrane separated, when inactive, from a resistive track.

12. The electromagnetic switch device according to claim 8, further comprising a first cut-out circuit provided by a static contact connected to the excitation coil.

13. The electromagnetic switch device according to claim 8, wherein said power supply is a switching mode power supply.

14. The electromagnetic switch device according to claim 8, wherein said position sensor comprises a pressure sensitive member on which operate force application means displaced by said mobile assembly.

* * * * *